US008365553B2

(12) United States Patent
Huynh

(10) Patent No.: US 8,365,553 B2
(45) Date of Patent: Feb. 5, 2013

(54) JEWELRY ITEM FOR SELECTIVE DISPLAY OF COLORED REGIONS HIDDEN BENEATH A GEMSTONE

(76) Inventor: Chi Huynh, San Dimas, CA (US)

( * ) Notice: Subject to any disclaimer, the term of this patent is extended or adjusted under 35 U.S.C. 154(b) by 276 days.

(21) Appl. No.: 12/887,201

(22) Filed: Sep. 21, 2010

(65) Prior Publication Data

US 2012/0067083 A1 Mar. 22, 2012

(51) Int. Cl.
*A44C 17/02* (2006.01)

(52) U.S. Cl. ..... 63/26; 29/10

(58) Field of Classification Search ..... 63/26–28, 63/29.1–29.2, 30, 31, 15; D11/91–92; 29/10, 29/896.4, 896.41, 896.411, 896.412
See application file for complete search history.

(56) References Cited

U.S. PATENT DOCUMENTS

| | | | | |
|---|---|---|---|---|
| 303,424 | A * | 8/1884 | Dutemple | 63/27 |
| 722,824 | A * | 3/1903 | Dover | 63/27 |
| 736,022 | A * | 8/1903 | Rohde | 63/28 |
| 1,392,604 | A | 10/1921 | Smith | |
| 2,070,157 | A * | 2/1937 | Dinhofer | 63/27 |
| 2,447,407 | A | 8/1948 | Grain | |
| 2,511,510 | A | 6/1950 | Mukai | |
| 2,535,807 | A | 12/1950 | Moyd | |
| 2,596,965 | A | 5/1952 | Troy | |
| 3,835,665 | A | 9/1974 | Kitchel | |
| 4,809,417 | A | 3/1989 | Normann, Jr. | |
| 5,454,234 | A | 10/1995 | Karmeli | |
| 5,632,164 | A | 5/1997 | Bergagnini | |
| D432,938 | S | 10/2000 | Vardakis et al. | |
| 6,430,963 | B1 | 8/2002 | Friedman et al. | |
| 6,649,009 | B1 | 11/2003 | Kim | |
| 7,225,642 | B2 | 6/2007 | Katz et al. | |
| 2004/0237585 | A1 * | 12/2004 | Golden et al. | 63/26 |
| 2005/0274144 | A1 | 12/2005 | Goughnour et al. | |
| 2007/0157665 | A1 * | 7/2007 | Lai | 63/26 |
| 2007/0209390 | A1 | 9/2007 | Malinowski | |
| 2008/0163647 | A1 * | 7/2008 | Rosen | 63/28 |
| 2008/0184739 | A1 | 8/2008 | Huynh | |

* cited by examiner

*Primary Examiner* — Jack W. Lavinder
*Assistant Examiner* — Abigail E Morrell
(74) *Attorney, Agent, or Firm* — Biotech Beach Law Group PC

(57) ABSTRACT

A jewelry item including a gemstone mounted to a gemstone setting having a plurality of reflective surfaces that selectively display colors from a region hidden beneath the gemstone while preventing viewing of the colored region through the gemstone itself.

11 Claims, 7 Drawing Sheets

JEWELRY ITEM FOR SELECTIVE DISPLAY OF COLORED REGIONS HIDDEN BENEATH A GEMSTONE

TECHNICAL FIELD

The present invention relates to jewelry items including gemstone settings and more specifically to a jewelry item including a gemstone mounted to a gemstone setting having a plurality of reflective surfaces that selectively display colors from a region hidden beneath the gemstone while preventing viewing of the colored region through the gemstone itself.

BACKGROUND OF THE INVENTION

Gemstones are minerals obtained from the earth or in some cases developed in the laboratory. The top of the gemstone is referred to as the crown. The crown frequently has polished cut surfaces called facets for enhancing the reflective nature of the gemstone. Among these facets are the table, star facets and bezel facets. The midline of a gem is referred to as the girdle. The area below the girdle is referred to as the pavilion. Facets around the pavilion are commonly referred to as lower girdle facets and pavilion facets. The pavilion is typically faceted to reflect internal light creating enhanced brilliance. Below the pavilion and at the bottom of the gemstone is the cutlet. The cutlet is typically pointed such that the pavilion maximizes internal reflection of light.

Gemstone arrangements are often constructed to enhance the appearance of precious and semi-precious gems. Frequently these arrangements are constructed to mask the quality of an inferior gem or to tint to the gem with a desired color without altering the gem's chemical composition. One such technique includes mounting a secondary gem having a desired color or reflective property in close proximity to the primary gem. The effect is a primary gem that appears to have a desired hue or enhanced brilliance. While the secondary gem may or may not be visible its purpose is to enhance the appearance of the primary gem.

U.S. Pat. No. 4,809,417 by Norman, Jr. (the '417 patent) discloses a method of making a multiplet jewelry product with an internally embedded visual indicia. The methods include providing a transparent layer and a gemstone, each having an interfacial surface, affixing visual indicia to one of the interfacial surfaces by applying a coating, and securing the interfacial surfaces together. The indicia are viewed through the transparent layer. Thus the '417 patent describes housing visual indicia within a gem for viewing through the gemstone itself.

U.S. Pat. No. 5,664,440 by Roemer (the '440 patent) discloses a composite ring including a band, an outermost stone comprising a diamond and a innermost stone being a colored stone. The innermost stone is placed beneath the diamond at a spacing of 0.1 mm to 2 mm. The color of the innermost stone is visible when viewing the diamond. Thus, the innermost stone tints the diamond and thus contributes to the apparent coloring of the diamond itself.

U.S. Pat. No. 5,868,008 by Yamaura et al (the '008 patent) discloses a jewelry ornament including a base with a hole formed in a central portion thereof, a transparent or semi-transparent gem is held by a prong mount and a colored back-up gem at is least partially positioned in the hole. The purpose of the '008 patent is to enhance the gem's original color so it appears to have a higher color grade. In addition the gem retains the faceted pavilion commonly observed with gemstones for brilliance and sparkle.

U.S. Pat. No. 6,782,715 by Ruth (the '715 patent) discloses a primary gem including a brilliant cut diamond and a plurality of at least four complementary gems including a brilliant cut diamond. The complementary gems are positioned to reflect light lost by the primary diamond. In essence, the '715 patent discloses a gemstone setting where a set of complementary diamonds return light that was not correctly reflected by the diamond's faceted pavilion. Thus, the '715 patent discloses a setting to mask imperfections in the faceted pavilion and to enhance the brilliance of the brilliant cut diamond. As such, the complementary gems affect the appearance of the primary diamond.

The above inventions demonstrate traditional goals of the jewelry industry, which is to enhance the coloring or brilliance of the gemstone. That is, the above inventions commonly enhance the appearance of the gem itself through various optic techniques. However, while each addresses a process to affect the primary gem they do not consider affects which may enhance the setting. That is, while the above techniques advance perceived coloring or manipulation of the gemstone itself, advancements in gemstone settings are often overlooked.

There are however, those that advance the gemstone setting itself. For instance U.S. Pat. No. 5,520,017 by Vivat (the '017 patent) provides an improved jewelry device with an invisible gemstone setting. That is, the advancement in the gemstone setting is to reduce its appearance. Thus, the '017 patent can itself be considered an advancement in the appearance of the gemstone since the goal is to not view the setting.

SUMMARY OF THE INVENTION

While traditional gemstone design focuses on enhancing the appearance of a gemstone separate from its setting, the present invention addresses the jewelry item as a unit by adding optical features not directly visible through the gemstone. Accordingly, it is an object of the invention to provide optical features that enhance the display of a gemstone without significantly affecting the gemstone itself.

The above is accomplished by providing a jewelry item including a gemstone; a gemstone setting; and a mounting piece. The gemstone setting includes a base member including a contoured inner surface and a plurality of angled reflective surfaces, and a support member positioned above and extending inward from the base, the support member including at least one aperture for exposing the plurality of reflective surfaces to an outer environment. The mounting piece includes a colored layer positioned underneath an opaque barrier thereby preventing direct viewing of the colored layer through the gemstone; and the plurality of angled reflective surfaces are angled to selectively reflect colored regions of the colored layer to an area outside of the jewelry object. Exemplary gemstones are those selected from the group consisting of an agate, an alexandrite, an amber, an ametrine, an amethyst, an aquamarine, an apatile, a beryl, a bloodstone, a chrysoberyl or cat-eye, a citrine, a corundum, a chalcedony, a chysocolla, a coral, a diamond, an emerald, a green beryl, a garnet, a quartz, a lolite, a jadeite, a kupzite, a lapis lazuli, a moonstone, a malachite, a moamite, an onyx, an opal, a peridot, a red corundum, a ruby, a sardonyx, a sapphire, a spessartime, a sphene, a spinel, a star ruby and sapphiren, a sunstone, a tanzanite, a tiger eye, a tourmaline, a topaz, a turquoise, a tsavorite, and a zircon.

The plurality of angled surfaces may be positioned around the perimeter or circumference of the gemstone and are typically each angled to display only a single color of a colored layer that itself includes two or more colors. In some embodiments the colored layer includes a first color surrounded by a second color.

In another embodiment of the present invention a jewelry item is provided, which includes a gemstone including a gem as an upper layer, an opaque barrier as a middle layer and a lower layer including at least two colors, wherein the opaque barrier prevents viewing of the at least two colors through the gemstone; and a gemstone setting including a base member including a contoured inner surface and a plurality of angled reflective surfaces, and a support member positioned above and extending inward from the base, the support member including at least one aperture for exposing the plurality of reflective surfaces to an outer environment; and wherein the plurality of angled reflective surfaces are angled to selectively reflect colored regions of the lower layer to an area outside of the jewelry object.

In a related embodiment, a method of manufacturing a jewelry item is provided, which includes providing a gemstone; forming a mounting piece by covering a colored layer with an opaque barrier including a different color than the colored layer; determining a three dimensional positioning of each color of the colored layer within the jewelry item and a three dimensional positioning of a plurality of apertures for selectively viewing each color; contouring a base member from an opaque material, which includes forming an inner surface to avoid reflection of the colored layer through the plurality of apertures and forming a plurality of reflective surfaces for optical alignment between the colored layer and the plurality of apertures to reflect each color of the colored layer through the plurality of apertures; forming a support member to support the mounting piece and to form the plurality of apertures; mating the support member to the base member and to the mounting piece, wherein the mounting piece is positioned above the plurality of reflective surfaces; and mounting the gemstone to the mounting piece.

BRIEF DESCRIPTION OF THE DRAWINGS

FIGS. 3A and 3B each demonstrating a recess site 32 for reflective surfaces 26 angled for reflection of a central red portion 20*r* of the mounting piece 14.

DETAILED DESCRIPTION OF THE PREFERRED EMBODIMENT

Figure 1:
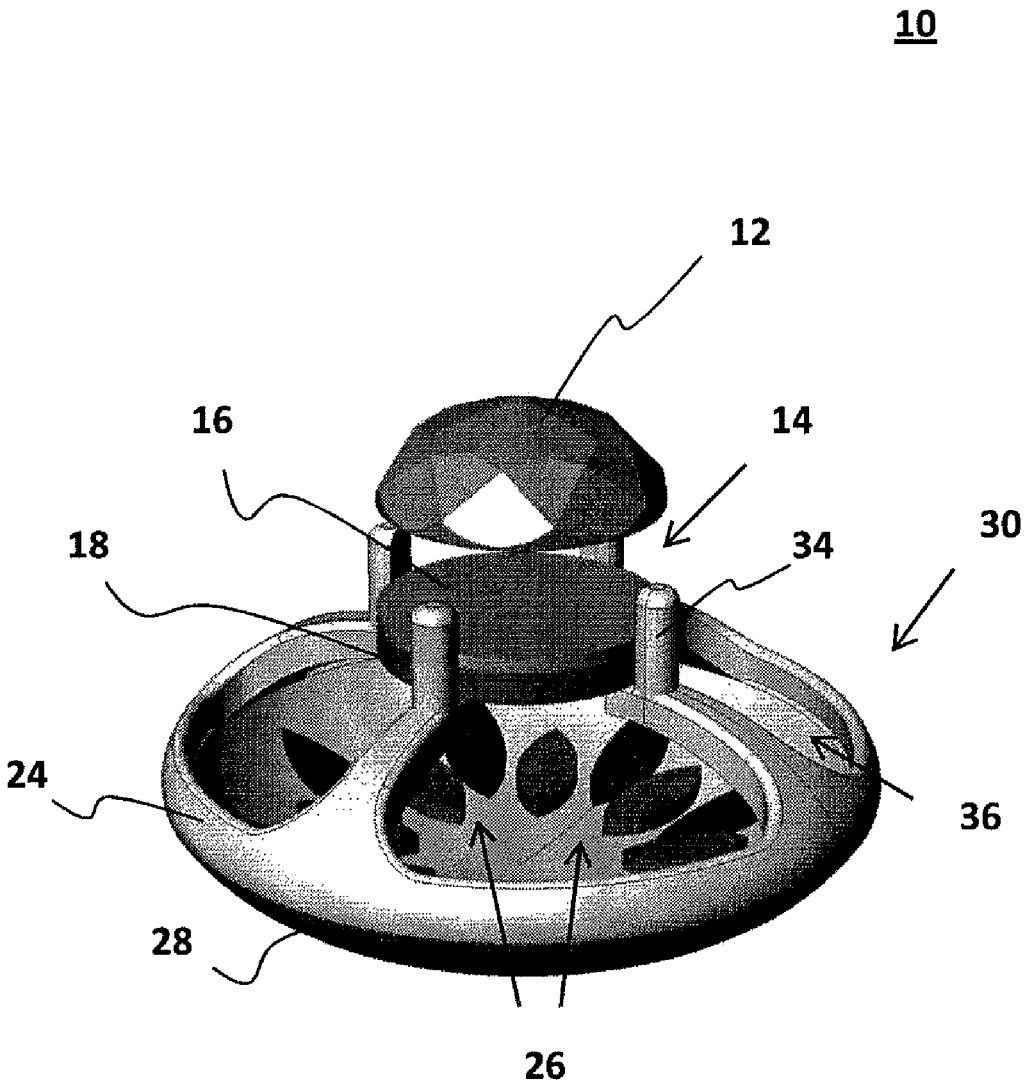
FIG. 1 is a partially exploded view of an exemplary jewelry item 10 depicting a gemstone 12 free from contact with the mounting piece 14 thereby exposing the opaque barrier 16.
Figure 3B:
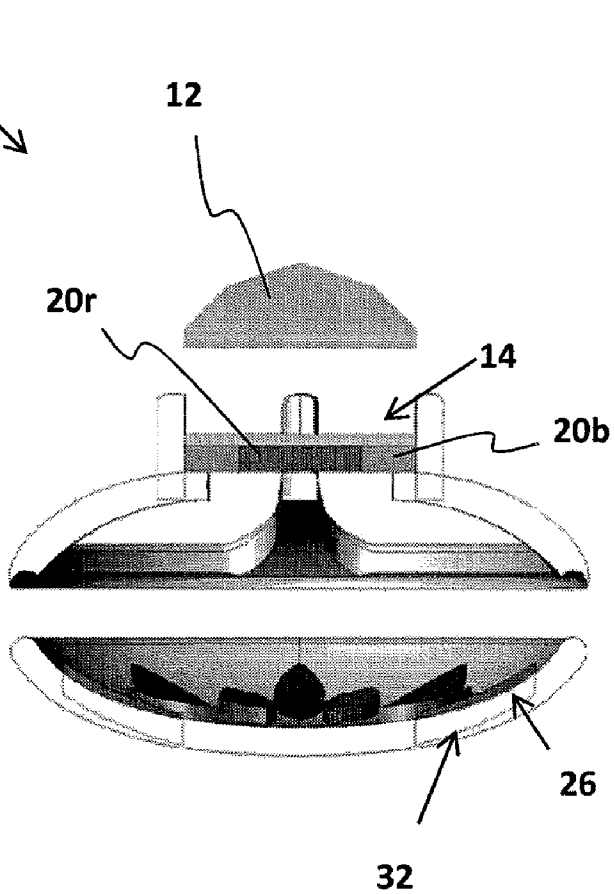
FIG. 3A is a cutaway view of the jewelry item 10 and FIG. 3B is an exploded cutaway view of the jewelry item 10 depicting the gemstone 12 separated from the mounting piece 14 and the support structure 24 separated from the base 28.
Figure 3A:
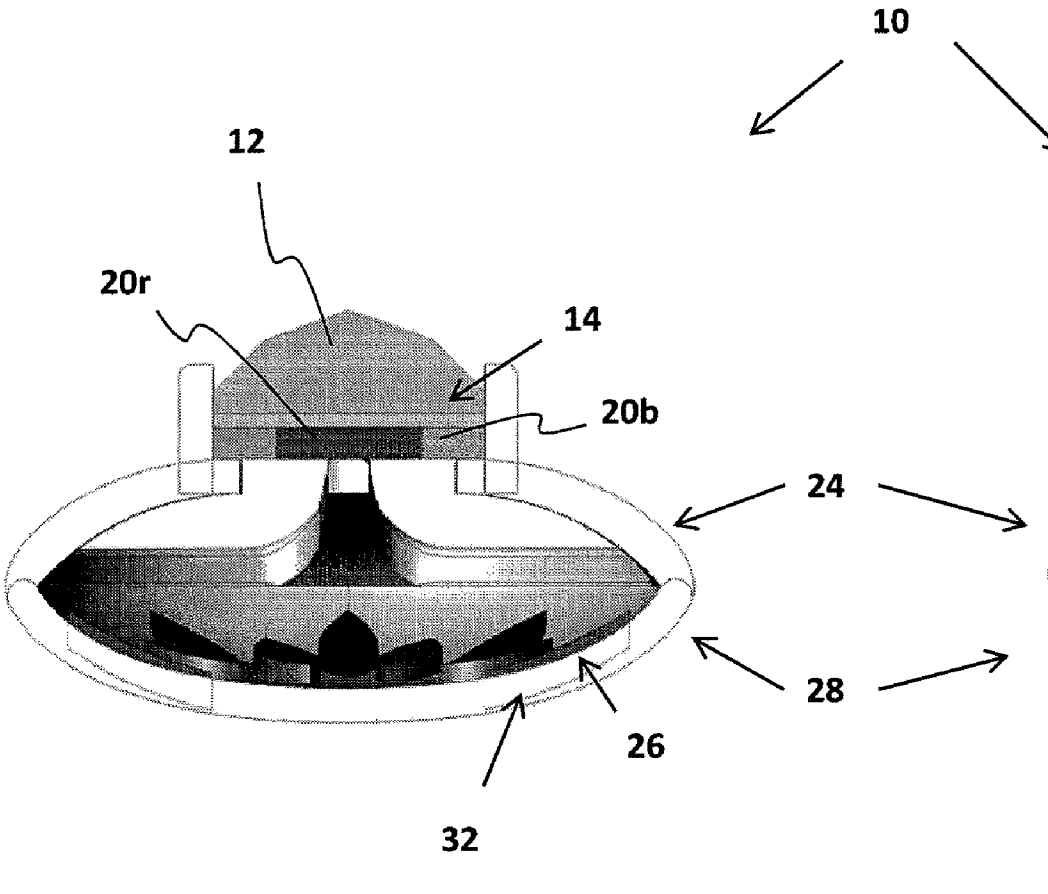

The principles of the jewelry items of the present invention may be better understood with reference to the drawings and the accompanying description. Referring now to the drawings, FIGS. 1, 3A and 3B depict a jewelry item generally designated 10, constructed according to the teachings of the present invention. For sake of example only, jewelry item 10 is fashioned as an item designed to be worn by a user. For instance, jewelry item 10 may be fashioned for a user to wear such as for example, as a pendent or a charm together with a necklace or a bracelet. Alternatively, the jewelry item 10 may be fashioned as a ring. Still further, the jewelry item 10 may be fashioned as a broach, pin, tie tack, cuff link and the like.

The skilled artisan will recognize that the jewelry item 10 provided herein may include a variety of one or more gemstones 12, which may be provided alone or together. The gemstone 12 may be any such gem known to those in the jewelry arts, such as a precious gem or a semi-precious gem. As a non-limiting example, the gemstone 12 may be selected from the group of an agate, an alexandrite, an amber, an ametrine, an amethyst, an aquamarine, an apatile, a beryl, a bloodstone, a chrysoberyl or cat-eye, a citrine, a corundum, a chalcedony, a chysocolla, a coral, a diamond, an emerald, a green beryl, a garnet, a quartz, a lolite, a jadcite, a kupzite, a lapis lazuli, a moonstone, a malachite, a moamite, an onyx, an opal, a peridot, a red corundum, a ruby, a sardonyx, a sapphire, a spessartime, a sphene, a spinel, a star ruby and sapphiren, a sunstone, a tanzanite, a tiger eye, a tourmaline, a topaz, a turquoise, a tsavorite, and a zircon. Preferably, the gemstone 12 is a transparent or semi-transparent gem.

While the top or crown of the gemstone 12 is preferably faceted, the bottom surface of the gemstone 12 is preferably flat or planar. As will become apparent, a flat or planar bottom surface may facilitate fusion or attachment to the mounting piece 14. However, those skilled in the art will recognize that the bottom surface of the gemstone 12 may be contoured for mating with a complementary mounting piece 14. That is, the gemstone 12 and mounting piece 14 may have complementary surfaces for engagement or fixation. The term "complementary surfaces" is intended to encompass surfaces that have complementary contours for mating, such as those that contact each other along eighty percent or more of the mating surface, preferably more than 90% of the mating surface. FIG. 1 provides an exploded view demonstrating in part, a gemstone 12 shaped complementary for attachment or contact with the mounting piece 14. When referring to "attachment", preferably attachment is not reversible. That is, preferably "attachment" is permanent attachment, such as through the use of adhesives known in the jewelry industry.

Also as can be seen in FIG. 1, the mounting piece 14 includes an opaque barrier 16 which prevents viewing of a colored layer 18 through the gemstone 12. Thus, in contrast to traditional jewelry design; while the present invention does provide a secondary colored object, namely the colored layer

Figure 4A:
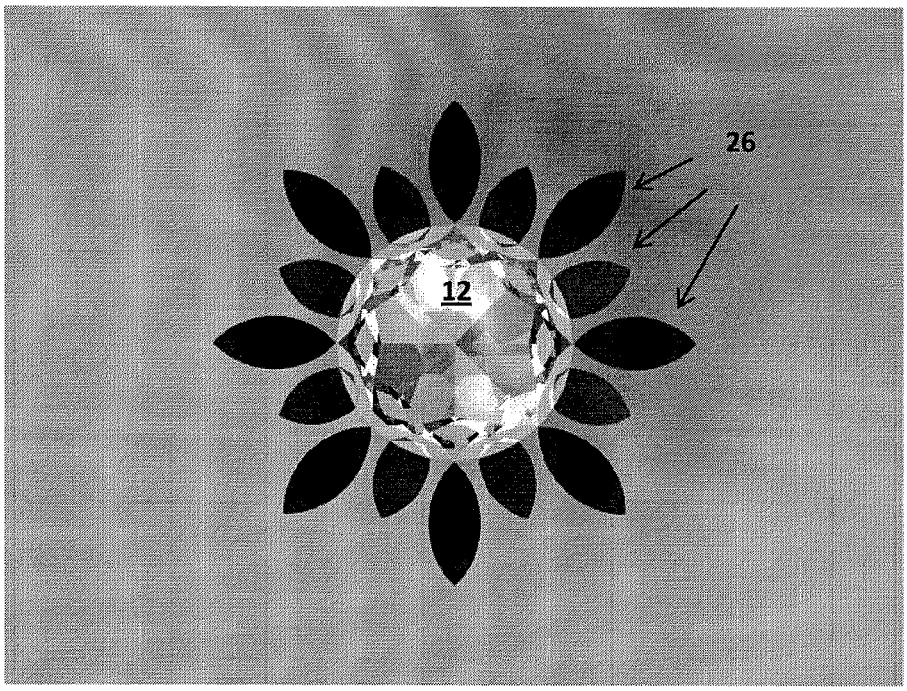
FIG. 4A is a photograph of a top plan view of a preferred embodiment revealing a plurality of reflective surfaces 26 selectively displaying colors blocked from direct viewing through the gemstone 12; whereas in FIG. 4B the plurality of reflective surfaces 26 selectively display colors also viewed through the gemstone 12.
Figure 4B:
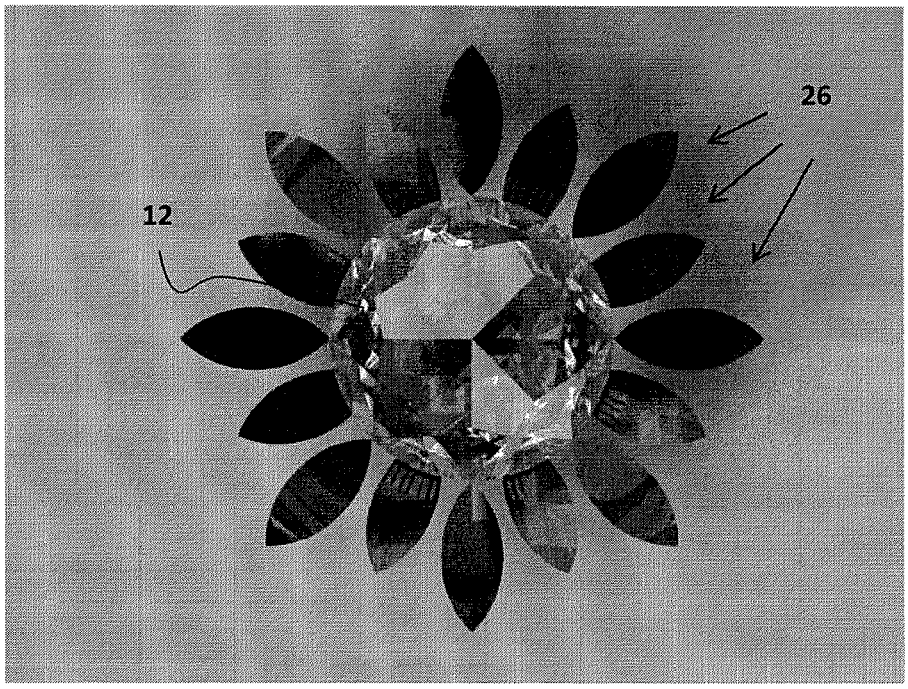
Figure 5A:
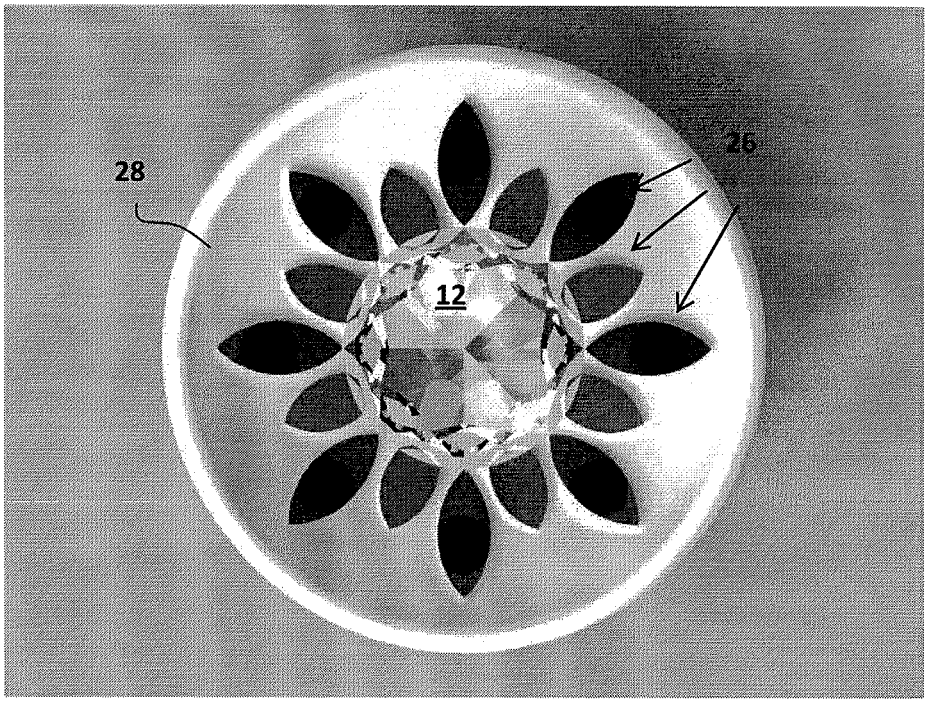
FIG. 5A is a photo of the top plan view of a preferred embodiment revealing a plurality of reflective surfaces 26 along a base member 28, the reflective surfaces 26 selectively displaying colors blocked from direct viewing through the gemstone 12.
Figure 5B:
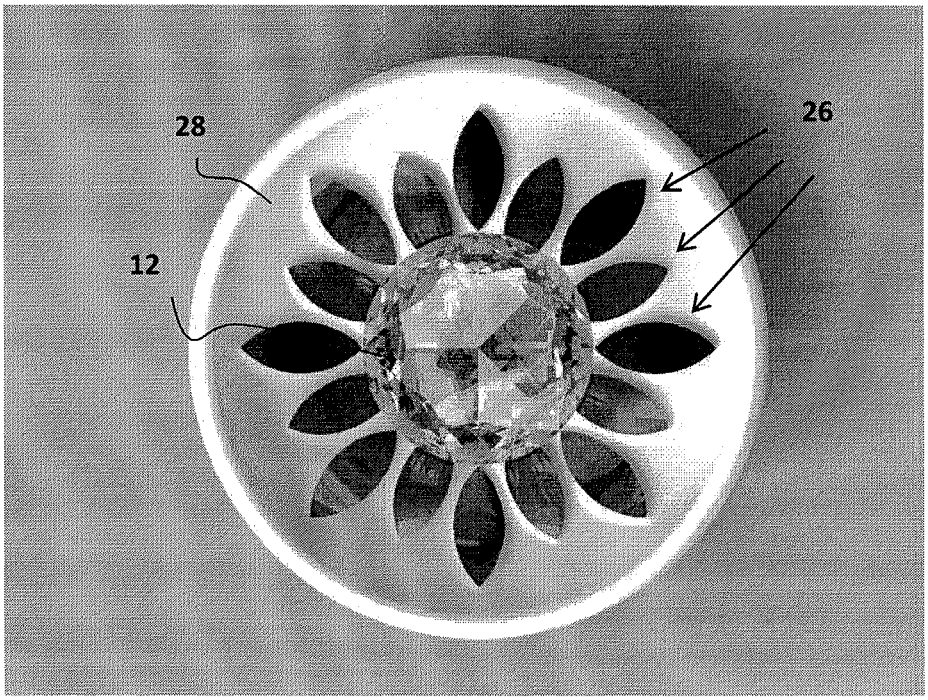
FIG. 5B is a photo of the top plan view off reflective surfaces 26 along a base member 28, the reflective surfaces 26 selectively displaying colors also viewed through the gemstone 12.

18 of the mounting piece 14, the opaque barrier 16 prevents coloring of the gemstone 12 by the colored layer 18. This feature is evident viewing FIGS. 4A, 4B and FIGS. 5A and 5B, wherein FIGS. 4A and 5A demonstrate blocking the display of the colored layer 18 through the gemstone 12; whereas FIGS. 4B and 5B permit viewing of color layer 18 through the gemstone 12. The mounting piece 14 may be provided in a variety of configurations depending on the preferences of the user; however, in a preferred embodiment the mounting piece 14 is generally disc-shaped having at least two distinct colors on the lower surface of the colored layer 18 and an opaque layer 16, which may be the same color as the gemstone 12. The mounting piece 14 may be constructed from any suitable material such as plastic, metal, metal alloy and the like. The opaque layer 16 may be a coating applied to the colored layer 18. The mounting piece 14 may be properly aligned for attachment with the support member 24 by placement between a set of prongs 34 along the support member 24.

While the mounting piece 14 has been primarily addressed due to its colored layer 18 and opaque barrier 16, the mounting piece 14 also may serve to mount a variety of gemstones 12 to the gemstone setting 30. By providing a gemstone setting 30 with mounting piece 14 attached, the combination can be provided to a jeweler as a unit, which allows the jeweler to choose the desired gemstone 12 for mounting to the mounting piece 14 thereby tailoring the jewelry item 10 to an individual's preference.

Although in preferred embodiments colored regions 20 within the colored layer 18 are not viewed directly through the gemstone 12, colored regions 20 themselves are displayed by peering through one or more apertures 36 within the support member 24. The aperture 36 is preferably cast into the support member 24. Preferably each of the plurality of reflective surfaces 26 is exposed through one or more apertures 36 of the support member 24 for direct viewing thereby allowing each reflective surface 26 to display a colored region 20 to the user while the opaque layer 16 prevents display of the colored regions 20 through the gemstone 12. Referring to FIGS. 1-3B select portions of the colored regions 20*r*, 20*b* are displayed via reflection by a plurality of angled reflective surfaces 26, which are positioned along an inner surface of the base member 28. The base member 28 does not reflect the colored regions 20 through the apertures 36.

Figure 2A:
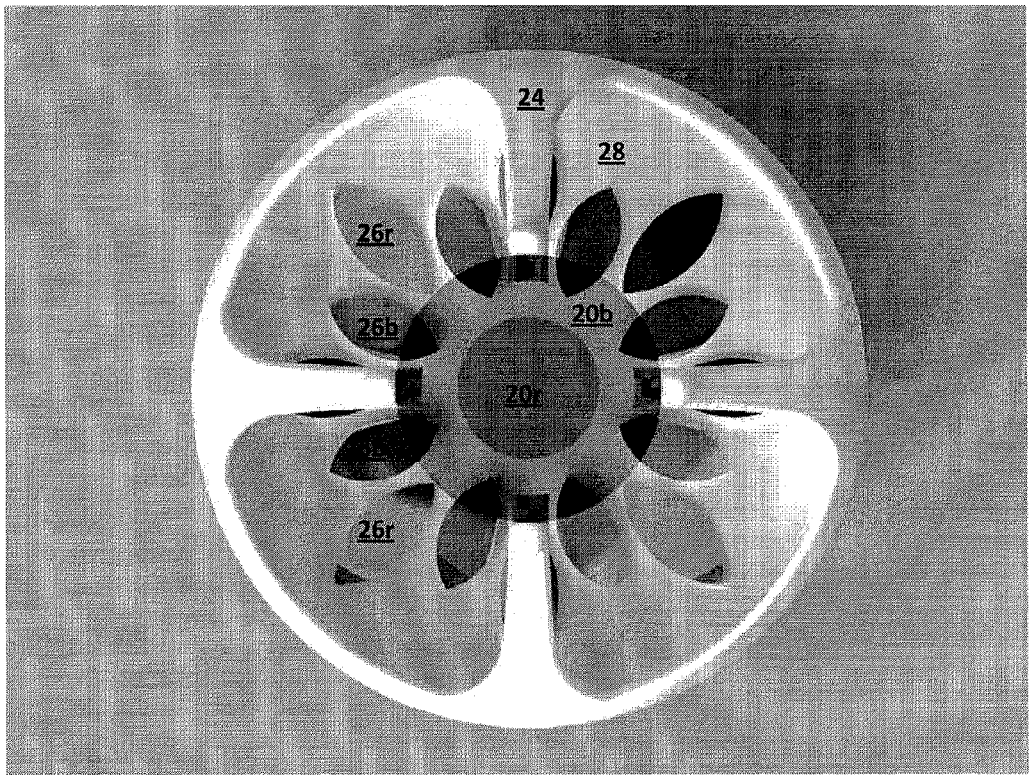
FIG. 2A is a top plan view depicting the colored layer 20 (20*r* and 20*b*) supported above a plurality of reflective surfaces 26 (26*r* and 26*b*) by a support member 24.
Figure 2B:
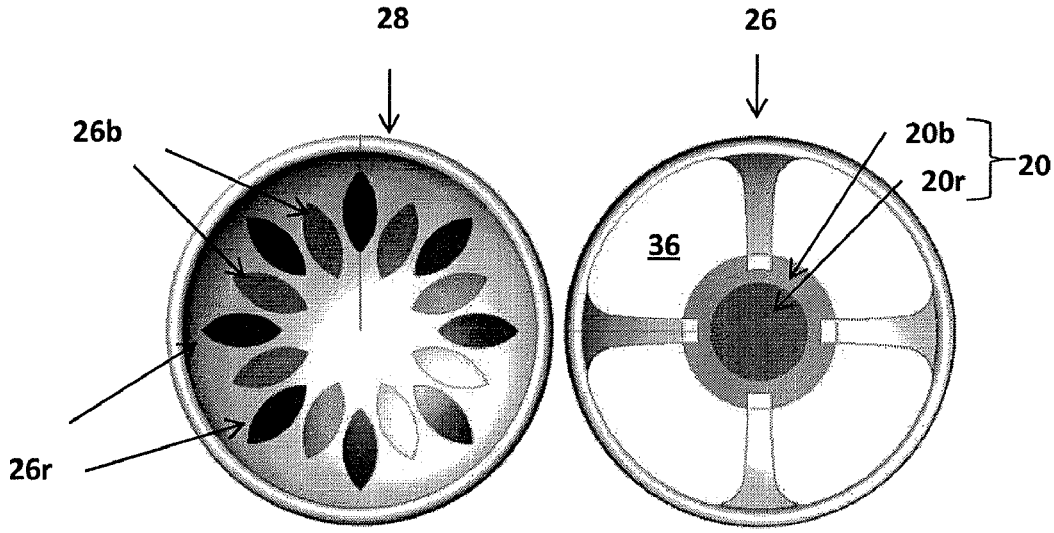
FIG. 2B shows the base member 28 detached from the support member 26 thereby demonstrating an exemplary arrangement of reflective surfaces 26 (26*r*, 26*b*) for selective reflection of a central red colored region 20*r* and a surrounding blue colored region 20*b* within the colored layer 20*r*, 20*b*.
Figure 2C:
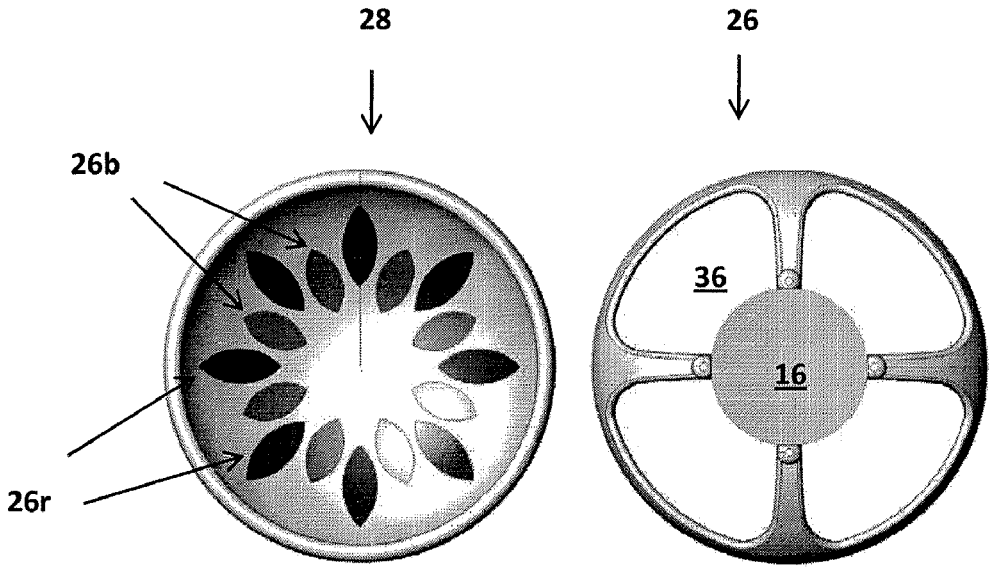
FIG. 2C depicts the view of FIG. 2B after addition of the opaque barrier 16.

Turning to the base member 28 and support member 24 of the gemstone setting 30, FIGS. 1 and 3A demonstrate their attachment while FIGS. 2B and 2C demonstrate their separation prior to attachment. Each may be constructed from a variety of materials known in the jewelry and manufacturing arts. For instance, the base member 28 and support member 24 may each independently be selected from a plastic, metal, semi-metal, metal alloy and the like. When using materials that have reflective properties such as reflective metals, the contoured inner surface 30 of the base member 28 can be coated with a non-reflective coating to prevent reflection. Alternatively, the contoured inner surface 30 may be contoured such that it is not optically aligned to view colored regions 20 through the apertures 36. That is, while the plurality of reflective surfaces 26 are intended to reflect a hidden portion(s) of the colored layer 18, the surrounding surfacing of the base member 28 is intended to not be substantially reflective. The terms "not substantially reflective" and "substantially non-reflective" refer to the inability of the average user to identify the color of the colored regions 20*r*, 20*b* by peering directly at the base member 28 without viewing the reflective surfaces 26. Thus, in preferred embodiments the colored regions 20*r*, 20*b* are displayed only via reflection by the plurality of angled reflective surfaces 26. Again, this reflection is viewed by peering through at least one aperture 36 of the upper support member 24.

The ordinary skilled artisan will recognize the structural shape and configuration of the base member 28 and support structure 26 may vary widely and may incorporate planar, concave or convex surfaces and the like. Further, the support member 26 may incorporate prongs 34 to assist in retaining a mounted gemstone 12, to assist in the desired positioning of the mounting piece 14 and the like. During manufacture, the base member 28 and upper support member 26 are preferably cast separately then attached such as with a jeweler's adhesive. In a preferred embodiment the base member 28 is concave and the support structure 26 is generally convex permitting their attachment along an annular ringed surface. The support structure 26 providing the only access to the plurality of reflective surfaces 26 ensures the colored regions 20 themselves are well hidden from direct viewing but well viewed indirectly. The term "direct viewing" as used herein refers to viewing without reflection; whereas the term "indirect viewing" as used herein refers to viewing of a reflection.

As can be better understood viewing FIGS. 2A-B, a plurality of angled reflective surfaces 26 are provided in a configuration to selectively reflect a colored region 20*r*, 20*b* of the colored layer 18 of the mounting piece 14. That is, each of the plurality of reflective surfaces 26 is positioned and angled corresponding to a select colored region 20*r*, 20*b* or portion of the colored layer 18. Accordingly, by determining the spatial coordinates of the desired colored region 20*r*, 20*b*, each reflective surface 26 can be precisely angled for desired display. As such, one skilled in the present art will appreciate that when providing at least two colored regions 20*r*, 20*b*, each of the reflective surfaces 26 can be independently angled to selectively display only a single color from a colored layer 18 having two or more colored regions 20*r*, 20*b* of different colors. This exemplified in FIGS. 2A-C, which depicts a colored layer 18 having an inner red region 20*r* and a surrounding blue region 20*b*; however, in FIG. 2C an opaque barrier 16 prevents direct viewing. In FIGS. 2A-C, the plurality of angled surfaces 26 are independently angled to selectively display either red 26*r* or blue 26*b*. A skilled artisan will now understand that since each of the plurality of reflective surfaces 26 can be individually angled for desired reflection, numerous variations can be accomplished with instructions and guidance provided herein.

Selective display of colored regions 20 is typically performed by determining the spatial positioning of the desired colored region 20*r*, 20*b* and angling the reflective surface 26 such that an optical path vector intersects the desired portion of the colored layer 18. Such calculations may involve determining the angle or position of the colored region 20*r*, 20*b* and its relation to the position of the reflective surface 26 and the desired optical path. Once determined, angling the reflective surfaces 26 typically involves raising or lowering one or more ends of the reflective surface 26 until the desired reflection occurs or such that the angle of incidence equals the angle of reflection. In preferred embodiments, the angled reflective surfaces 26 are not parallel with the surrounding surface of the base member 28. That is, in preferred embodiments one or more regions of the reflective surface 26 is preferably raised above or recessed below the contour of the surrounding surface of the base member 28. In a preferred embodiment the reflective surfaces 26 are angled such that an optical path vector exits the jewelry item 10 generally perpendicular.

As introduced, the plurality of angled reflective surfaces 26 may be raised above, recessed below or partially raised above and partially recessed below the contoured inner surface of the base member 28. When raised above, the angle of each reflective surface 26 may be adjusted by increasing or decreasing the thickness of the material. For instance, angling a reflective surface 26 upward may be performed by increasing the relative thickness of a lower end of the reflective surface 26; and angling a reflective surface 26 downward may be performed by decreasing the relative thickness of the lower end of the reflective surface 26. Naturally, decreasing and increasing a higher end respectively may achieve the same result.

In another embodiment, angling of reflective surfaces 26 is performed by controlling the amount of recess in the base member 28. That is, by selectively increasing or decreasing the depth of a recess site 32 the angle of each reflective surface 26 can be controlled. A schematic of how angling reflective surfaces 26 using a variable recess approach is demonstrated in the cutaway view of FIGS. 3A and 3B where a colored layer 18 includes two colored regions 20, namely an inner red region 20*r* and an outer blue region 20*b*. Reflective surfaces 26 are shown with potential recess sites 32 along the base member 28 and thus only partially raised above the contour of the inner surface of the base member 28. Reflective surfaces 26 having a lower end with decreased recessing would tend to direct the optical path more upward and thus away from the center, which would tend to display the blue region 20*b*; whereas reflective surfaces 26 having increased recessing as shown in the potential recess site 32 at a lower end tend would tend to direct the optical path more towards the center of the colored layer 18 thereby displaying the red region 20*r*. The terms "lower end" and "higher end" are used for example purposes only and refer to an end of the reflective surface 26 nearest the center (lower end) of a concave base member 28 and farthest from the center (higher end) of a concave base member 28. One of ordinary skill in the art would be able to adapt this teaching for planar and convex base members 28 as well as those that have mixed contours.

Controlling angles via changing the depth of recesses in a base member 28 provides a preferred method since it permits the fabrication of each of the plurality of reflective surfaces 26 from the same material or having same specifications. That is, the thickness of the material itself may be constant. In other words, this permits each of the reflective surfaces 26 to be cut or molded from the same sheet or mould. For example, each of the angled surfaces 26 may be cut from a same sheet of reflective material then polished and added to each of the recesses in the base member 28 without the need of determining the paired matching of recess to surface 26. As a further example, the reflective surfaces 26 may be cut or moulded from a metal, metal alloy and the like using fabrication techniques known in the metal working arts and in particular, those applied to the jewelry arts. The surfaces 26 may be polished and attached to the base member 28 using an adhesive such as a jeweler's adhesive.

In another embodiment, the base member 28 itself is formed from a mould having the reflective surfaces 26 cast into the base member 28. That is, a mould having desired recesses, raised surfaces or a mixture thereof which form the plurality of reflective surfaces 26 may be integrated into the mould. Thus, in this embodiment there is no need to selectively place the reflective surfaces 26 on or in the base member 28. Selective display of colored regions 20 may be accomplished by calculating the optical path vector and molding the base member 28 into a configuration where only the reflective surfaces 26 display the desired regions 20*r*, 20*b*. That is, the surrounding contoured inner surface 30 of the base member 28 may be angled away from the colored regions 20*r*, 20*b* thereby preventing display by the surrounding contour of the base member 28. When forming moulds with recesses as reflective surfaces 26, care should be given not only to the angling of the reflective surface 26 but also transition angles. That is, if using recesses, preferably the recesses are formed by rounded grooves without sharp edges. Angled edges have been found in some instances to reflect white light, which prevents viewing of the colored regions 20.

Figure 6:
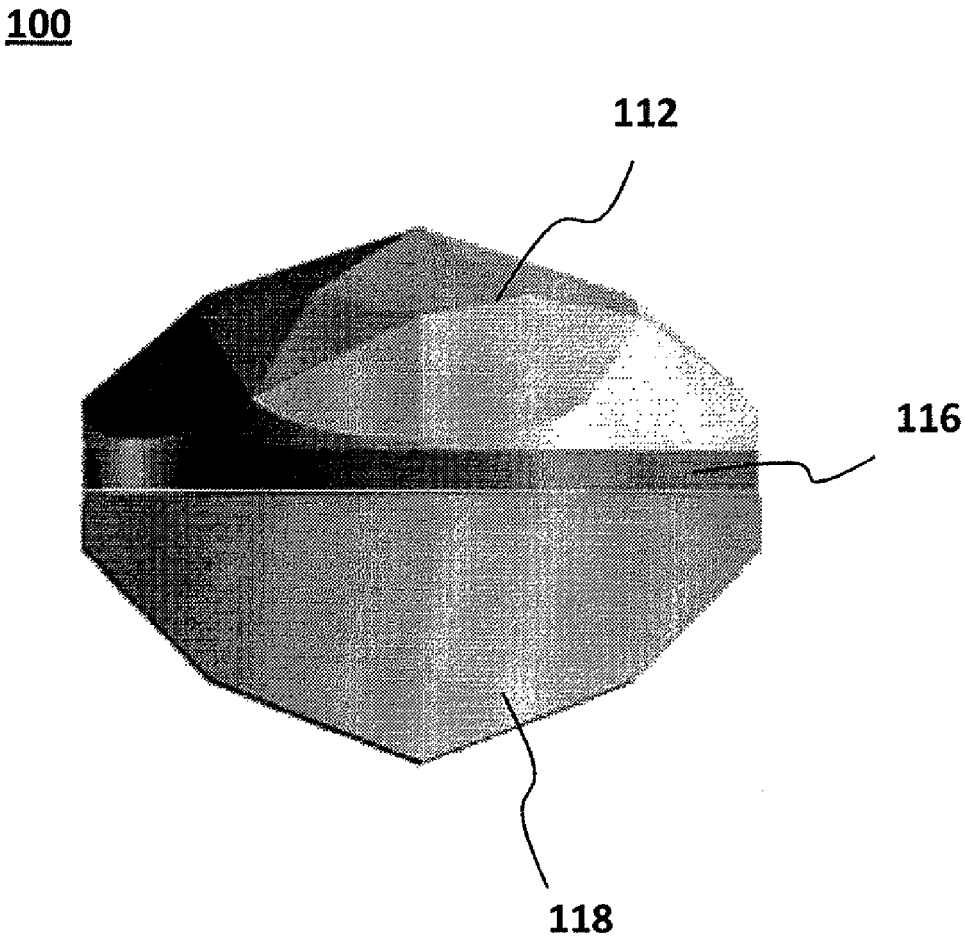
FIG. 6 is a side plan view of an alternative embodiment showing a composite gemstone 100 having a gem layer 112 provided together with an opaque barrier as a middle layer 116 and colored lower layer 118 for selective display.

In another embodiment of the present invention the support member 26 supports a composite gemstone 100 directly. An exemplary embodiment of a suitable gemstone 100 is provide in FIG. 6, which includes an upper gem portion 112 formed from a gem; an opaque barrier as a middle layer 116; and a lower layer 118 comprising at least two colors. In such an embodiment the gemstone 100 is positioned between the prongs 34 of the support member 24 to permit selective display of colors from the colored lower layer 118 by a plurality of angled reflective surfaces 26.

EXAMPLE 1

Manufacturing a Jewelry Item for Selective Display of Colored Regions Hidden Beneath a Gemstone The following is an exemplary method that may be used to form the jewelry item 10. Since the method may be used with any gemstone 12, the identity of the specific gemstone 12 itself is not critical; however, the sizing of the intended gemstone 12 should be known since the gemstone 12 is to be mounted to the setting. Accordingly an exemplary gemstone 12 should be provided to consider its dimensions.

The colors to be selectively displayed are considered and arranged in desired regions 20*b*, 20*r* to provide a colored layer 18. An opaque barrier 16, which is used to prevent direct viewing of the colored layer 18 through the gemstone 12, is added to cover the colored layer 18 thereby forming the mounting piece 14. The colored layer 18 and opaque barrier 16 are different colors. Since the mounting piece 14 typically supports the intended gemstone 12, either alone or in combination with prongs 34, or holds the colored layer 18 in the desired three dimensional position, either the colored layer 18 or the opaque barrier 16 is preferably sufficiently rigid to accomplish the need and thus preferably is constructed from any suitably rigid material.

The three dimensional positioning of each color of the colored layer 18 within the jewelry item 10 and the three dimensional positioning of a plurality of apertures 36 for selectively viewing each color are determined. This can be accomplished through the use of suitable computer programs such as computer aided design (CAD) programs, or by drafting an illustration of the intended jewelry item 10 and calculating the end dimensions.

The base member 28 is contoured from any suitable opaque material. Contouring includes forming an inner surface that avoids reflection of the colored layer 18 through the plurality of apertures 36 and forming a plurality of reflective surfaces 26 for optical alignment between the colored layer 18 and the plurality of apertures 36 to reflect each colored region 20 of the colored layer 18 through the plurality of apertures 36. The contours themselves can determined by considering various optical path vectors. The plurality of reflective surfaces 26 should be in optical or reflective alignment with the desired colored region 20 and aperture 26. Regions surrounding the reflective surfaces 26 should not be in such optical or reflective alignment. Alternatively, the regions by may be coated to prevent reflection. The reflective surfaces 26 may be formed in a casting process, which results in raised or recessed surfaces at appropriate angles. When recessing surfaces, rounded grooves are preferred since grooves having sharp angles tend to reflect white light or prevent the desired reflection of the colored region.

The support member 24 is formed to support the mounting piece 14 and to form the plurality of apertures 36. The support member 24 is mated to the base member 28 and to the mounting piece 14. Preferably, the mounting piece 14 is positioned above the plurality of reflective surfaces 26. Lastly, the gemstone 12 is mounted to the mounting piece 14. This last step can be performed during the construction of the setting or may be performed at a jewelry retailer by affixing the gemstone 12 to the mounting piece 14 using a jeweler's adhesive.

What is claimed is:

1. A jewelry item comprising a gemstone mounted to a gemstone setting, the gemstone setting comprising;

a) an opaque base member comprising a substantially non-reflective contoured inner surface and a plurality of angled reflective surfaces;

b) a support member positioned above and extending inward from the base member, the support member comprising at least one aperture for exposing the plurality of reflective surfaces to an outer environment; and c) a mounting piece comprising a colored layer positioned underneath an opaque barrier, wherein the opaque barrier prevents direct viewing of the colored layer through the gemstone;

wherein the plurality of angled reflective surfaces are each optically angled to selectively reflect a colored region of the colored layer through the at least one aperture to an area outside of the jewelry item.

2. The jewelry item according to claim 1, wherein the gemstone is selected from the group consisting of an agate, an alexandrite, an amber, an ametrine, an amethyst, an aquamarine, an apatile, a beryl, a bloodstone, a chrysoberyl or cat-eye, a citrine, a corundum, a chalcedony, a chysocolla, a coral, a diamond, an emerald, a green beryl, a garnet, a quartz, a lolite, a jadeite, a kupzite, a lapis lazuli, a moonstone, a malachite, a moamite, an onyx, an opal, a peridot, a red corundum, a ruby, a sardonyx, a sapphire, a spessartime, a sphene, a spinel, a star ruby and sapphiren, a sunstone, a tanzanite, a tiger eye, a tourmaline, a topaz, a turquoise, a tsavorite, and a zircon.

3. The gemstone setting according to claim 1, wherein the plurality of angled surfaces are positioned around the perimeter or circumference of the gemstone.

4. The jewelry item according to claim 1, wherein the plurality of reflective surfaces are each angled to display only a single color of the colored layer which comprises two or more colored regions.

5. The jewelry item according to claim 4, wherein the colored layer comprises a first color surrounded by a second color.

6. A jewelry item comprising:

a) a gemstone comprising a gem as an upper layer, an opaque barrier as a middle layer and a lower layer comprising at least two colors, wherein the opaque barrier prevents viewing of the at least two colors through the gemstone; and b) a gemstone setting comprising a base member comprising a substantially non-reflective contoured inner surface and a plurality of angled reflective surfaces, and a support member positioned above and extending inward from the base member, the support member comprising at least one aperture for exposing the plurality of reflective surfaces to an outer environment; and wherein the plurality of angled reflective surfaces are angled to selectively reflect colored regions of the lower layer to an area outside of the jewelry item.

7. A method of manufacturing a jewelry item comprising:

a) providing a gemstone;

b) forming a mounting piece by covering a lower surface of an opaque barrier with a colored layer comprising a plurality of colors, wherein the mounting piece comprises a rigid material;

c) determining a three dimensional positioning of each color of the colored layer within the jewelry item and a three dimensional positioning of a plurality of apertures for selectively viewing each color of the colored layer;

d) contouring a base member from an opaque material, wherein contouring comprises forming an inner surface to avoid reflection of the colored layer through the plurality of apertures and forming a plurality of reflective surfaces for optical alignment between the colored layer and the plurality of apertures to selectively reflect each color of the colored layer at the reflective surfaces and through the plurality of apertures;

e) forming a support member to support the mounting piece and to form the plurality of apertures;

f) mating the support member to the base member and to the mounting piece, wherein the mounting piece is positioned above the plurality of reflective surfaces; and g) mounting the gemstone to the mounting piece.

8. The method according to claim 7, wherein the step of forming a plurality of reflective surfaces comprises forming a plurality of rounded, reflective grooves.

9. A jewelry item formed by the method according to claim 7.

10. The method according to claim 7, wherein each of the reflective surfaces reflects a single color of the plurality of colors.

11. The method according to claim 10, wherein a first color of the plurality of colors is surrounded by a second color of the plurality of colors.

* * * * *